United States Patent [19]

Spisak

[11] 4,084,526

[45] Apr. 18, 1978

[54] METHOD OF FORMING RINGS

[76] Inventor: Edward G. Spisak, 35700 Oakwood La., Westland, Mich. 48185

[21] Appl. No.: 639,397

[22] Filed: Dec. 10, 1975

[51] Int. Cl.[2] ..... B21D 53/32

[52] U.S. Cl. ..... 113/116 E; 72/393

[58] Field of Search ..... 72/324, 338, 380, 381, 72/383, 384, 385, 386, 392, 393, 355, 394, 399, 402, 367, 368, 370; 113/116 UT, 118 R, 118 A, 118 B, 116 E; 228/141, 144

[56] References Cited

U.S. PATENT DOCUMENTS

| | | | |
|---|---|---|---|
| 743,193 | 11/1903 | Rainforth | 72/368 |
| 805,868 | 11/1905 | Marshall | 72/393 |
| 1,637,318 | 7/1927 | Stresau et al. | 228/144 X |
| 1,841,879 | 1/1932 | Croxford | 72/120 |
| 1,910,652 | 5/1933 | Taylor | 72/393 X |
| 2,089,476 | 8/1937 | Grotnes | 72/393 |
| 2,435,306 | 2/1948 | Grotnes | 72/393 X |
| 3,357,229 | 12/1967 | Luedi | 72/392 X |
| 3,798,728 | 3/1974 | Beisch | 113/116 E |
| 3,952,575 | 4/1976 | Straza et al. | 72/393 |

*Primary Examiner*—Lowell A. Larson
*Attorney, Agent, or Firm*—Fisher, Gerhardt & Groh

[57] ABSTRACT

A method of forming annular rings having portions of the ring material disposed radially of the ring axis from strips of flat material by forming cylindrical work-pieces from elongated strips of material with the ends of each of the strip being welded together to form a cylindrical work-piece having its material extending axially of the ring, supporting spaced annular portions at the inner circumference of the work-piece, and displacing a portion intermediate the internal annular portions of the work-piece radially outwardly while the outer perimeter of the work-piece is unsupported.

12 Claims, 18 Drawing Figures

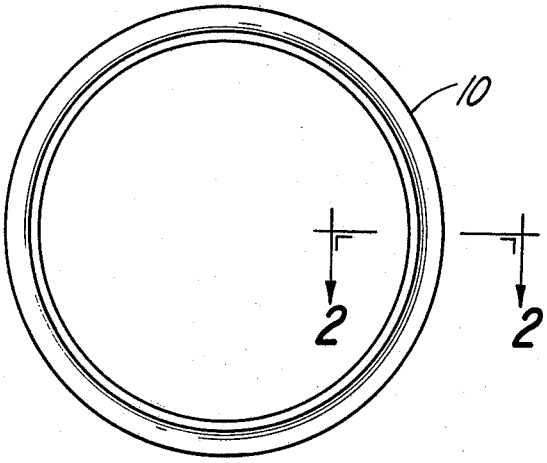
Fig-1
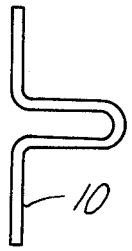
Fig-2
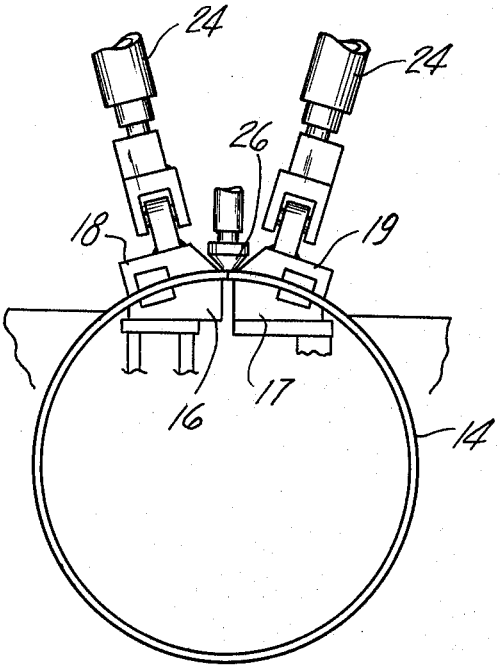
Fig-3
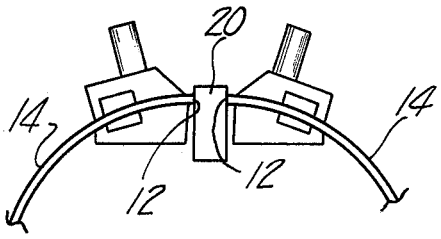
Fig-4
Fig-5
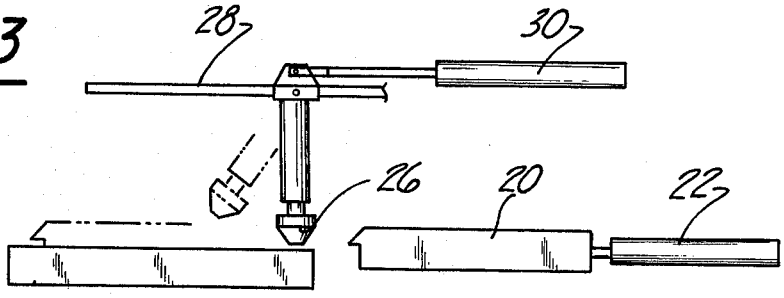

METHOD OF FORMING RINGS

This invention relates to a method of manufacturing annular metal rings from a strip of elongated material.

In the formation of metal rings in which the substantial portion of the material in the finished ring is to be disposed in a radial rather than in an axial direction, it has been customary to cut a flat annular ring from a flat sheet of metal and thereafter, to form the flat annular ring between dies affording the desired shape, usually with portions of the material being disposed in both an axially and radially extending direction. This results in a great waste of stock material since the unused material from the flat sheet usually is far in excess of the material content in the finished ring.

In an attempt to form annular rings in which a substantial portion of metal is disposed radially rather than axially, various methods have been attempted employing conventional manufacturing equipment and techniques. Annular rings have been formed by roll forming or die forming between opposed dies and by spinning. However, all of such processes employ mating dies in which portions of the metal become clamped between the dies while remaining portions are displaced. This causes the metal to be stretched up to or beyond its limits of elongation so that stretch marks and flaws are formed in the material which is particularly undesirable if the annular rings are of very thin metal or are to be used for ornamental purposes. In an attempt to avoid such stretching and marking, multiple step operations have been conducted to progressively form the annular ring and to size it. This requires excessive and elaborate equipment making the process economically unsound since the cost of the equipment is out of proportion to the savings in material.

It is an object of the invention to provide a method of making annular rings from flat strip material in which a substantial proportion of the material in the finished rings is disposed in a generally radial plane.

A method of forming annular rings is provided in which a cylindrical work-piece formed of an elongated strip of material is supported within the cylinder over the entire inner circumference and at axially spaced areas but is left completely unsupported at its outer circumferential surface during which time a force is exerted radially outwardly to displace material between the supported surfaces until the resultant work-piece has a substantial portion of its cross-sectional material content disposed radially. Thereafter, the work-piece can be separated into two rings in which the bulk of the cross-sectional material is disposed radially and results in a pair of annular rings which are free of stretch marks. The process makes it possible to displace material originally disposed axially of the ring in a generally radial direction without exceeding the elongation limits of the material.

FIG. 1 is a plan view of a ring formed in accordance with the method of the present invention;

FIG. 2 is a cross-sectional view at an enlarged scale of the ring shown in FIG. 1;

FIG. 3 is a schematic illustration of a welding machine employed in carrying out the method of the present invention;

FIG. 4 is a view of a portion of FIG. 3 showing another condition of operation;

FIG. 5 is a schematic side elevation of the welding machine shown in FIGS. 3 and 4;

Figure 6:
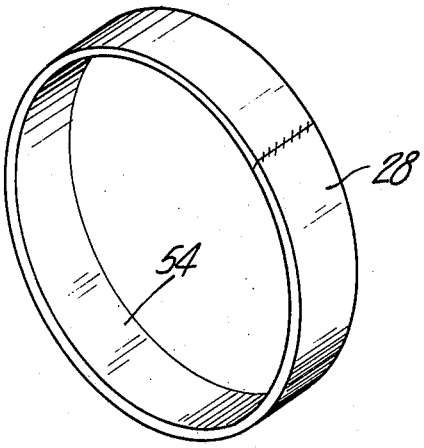
FIG. 6 is a perspective view of a work-piece used to form the ring shown in FIG. 1.

The method of the present invention is applicable to the formation of annular rings in which a substantial portion of the material in the ring is disposed radially of the axis of the ring and in which the ring is formed by displacing metal from a ring or cylindrically shaped work-piece originally having its material extending in an axial direction. This makes it possible to form the ring from elongated strip stock as opposed to the formation of rings from blanks of material cut from flat plate material.

Referring to the drawings, to form an annular ring 10 such as shown in FIG. 1 and having a cross section, as shown in FIG. 2, a strip of metal is cut to a length conforming substantially to the inner circumference of the finished ring. The width of the strip of material is equal to the length of the finished cross section of the ring, as shown in FIG. 2. The strip of material is subsequently bent into a circular form so that the ends 12 are adjacent to each other. This forms an initial work-piece 14 which requires joining, as by welding or the like of the adjacent ends 12. Such welding is preferably performed with welding equipment shown schematically in FIGS. 3, 4 and 5.

The welding machine includes a pair of lower clamps 16 and 17 and a pair of upper clamps 18 and 19. The clamps 16 and 18 are initially separated from the clamps 17 and 19 by a gauge bar 20, as shown in FIG. 4. The gauge bar 20 may be reciprocated horizontally relative to the clamps 16, 17, 18 and 19 by means of a hydraulic actuator or cylinder 22. The clamps 18 and 19 may be moved generally vertically relative to the lower clamps 16 and 17 by means of hydraulic cylinders 24. The welding machine also includes a welding head or nozzle 26 which as shown in FIG. 5 is supported on a horizontal way 28 for reciprocation in a horizontal direction by motor means indicated at 30. Provision is also made for retracting the welding head 26 upwardly and to an angular position, as indicated in broken lines, for retraction of the welding head 26 after a weld is completed. Preferably, the welding head forms a portion of a plasma type welding system by which adjacent ends 12 of the work-piece 14 are fused together in an oxygen free atmosphere such as argon gas or the like, utilizing the metal of the work-piece 14 and without the addition of any material by way of an electrode.

In an initial position of the welding machine, the clamps 16 and 18 are disposed at one side of the gauge bar 20 and the clamps 17 and 19 are disposed at the other side of the clamp bar 20. Also, the upper clamps 18 and 19 are spaced from the lower clamps 16 and 17 to receive the work-piece 14. The work-piece 14 is positioned with its ends 12 in abutment with the gauge bar 20, after which the hydraulic actuators 24 are operated to clamp the left end of the work-piece 14 between the clamps 16 and 18 and the right end of the work-piece 14 between the clamps 17 and 19. Thereafter, the hydraulic actuator 22 is operated to retract the gauge bar 20 from between the clamps 16, 18 and 17, 19 to the position shown in FIG. 3. By mechanism not shown, the right clamps 17 and 19 and left clamps 16 and 18 are moved toward each other to bring the ends 12 of the work-piece 14 into adjacent relationship with each other, as shown in FIG. 3. With the work-piece 14 in this position, the welding head or nozzle 26 is advanced towards the left as viewed in FIG. 5, to fuse the ends 12 of the work-piece 14 together to form a generally cylindrical ring-like work-piece which will hereafter be designated as 28, as shown in FIG. 6.

After the work-piece 28 is formed, the hydraulic actuator 22 is operated to return the gauge bar 20 to the left to the position shown in broken lines in FIG. 5. During such movement, the end of the gauge bar 20 engages the ring 28 and ejects it from the machine leaving the gauge bar 20 in position between the left and right clamps in readiness to receive the next work-piece 14.

After the weld has been formed in the ring 28, it may be desirable to perform finishing operations on the weld, particularly if the ring to be formed is for ornamental purposes. Such finishing operations may be performed by planishing in which the welded portion of the ring 28 is moved between opposed rollers which carefully size the material to that of the original thickness of the strip 14. If necessary, the weld may also be ground or buffed.

After the work-piece 28 has been welded, it is ready for forming or expanding from its generally cylindrical form, as shown in FIG. 6, to form a ring 10 having a cross section such as shown in FIG. 2. The apparatus employed for forming the ring 10 from the work-piece 14 is an expanding machine 32 shown in FIGS. 7 and 8.

Figure 8:
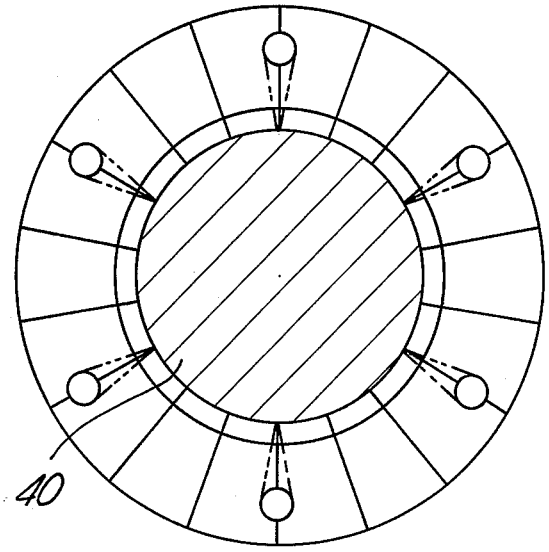
FIG. 8 is a view taken generally on line 8—8 in FIG. 7.

The expanding machine 32 is generally described as a cone type expanding machine or an expanding mandrel machine. As seen in FIG. 8, the machine includes forming apparatus with a plurality of segment assemblies 34, each of which includes a jaw 36 and a forming member or punch 38 detachably connected together. In their initial or retracted position the segment assemblies 34 are disposed in contact with each other, as shown in FIG. 8, and form an annular ring the center of which receives a cone 40. The cone 40 is connected by means of a draw bar 42 to a mechanism such as a hydraulic actuator 44 by which the cone may be pulled downwardly or raised upwardly.

Figure 7:
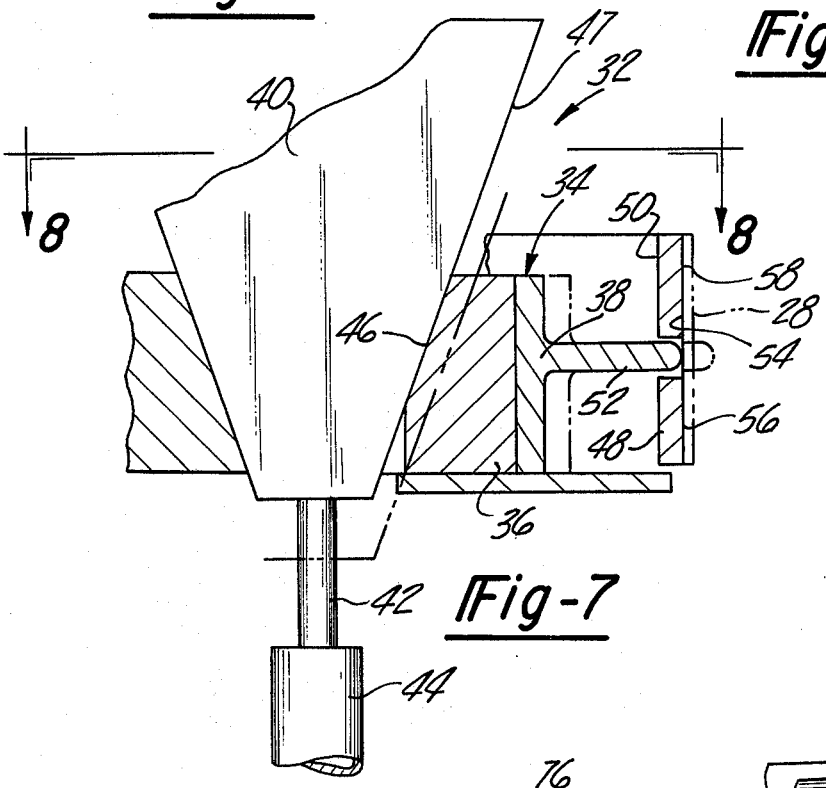
FIG. 7 is a schematic illustration of a metal expanding machine employed in carrying out the method of the present invention.

The jaws 36 are formed with an angular surface 46 conforming to the angular surface 47 of the cone 40. In the initial retracted position of the segment assemblies 34, as seen in FIGS. 7 and 8, all of the angular surfaces 46 are in engagement with the surface 47 cone 40. Operation of the hydraulic cylinder 44 to retract the latter, serves to move the cone 40 downwardly which causes all of the segment assemblies 34 to be moved radially outwardly simultaneously and equally relative to the axis of the cone 40.

Thus far, the expanding machine 32, which has been described is more or less conventional. However, for performing the present method of expanding, the machine 32 includes supporting apparatus having a lower support member 48 and an upper support member 50. Support members 48 and 50 form annular rings which are supported relative the expanding machine 32 and to each other with a spacing defining an annular opening sufficient to receive punch portions 52 of the forming shoes 38 therebetween.

Figure 9:
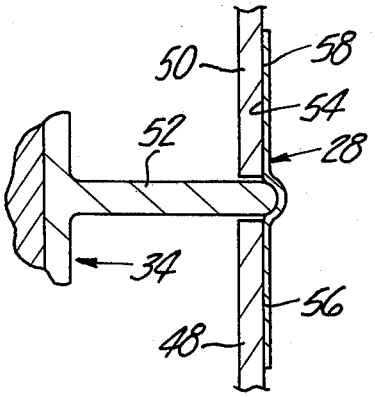
FIGS. 9, 10, 11 and 12 are schematic illustrations showing progressive steps in the expansion of a work-piece in accordance with the method of the present invention.
Figure 10:
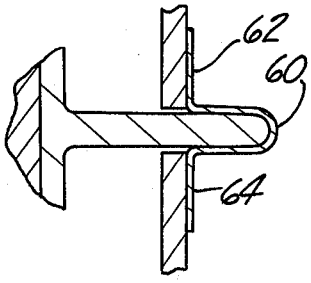

To operate the machine 32 in performing the method of the present invention, the ring-like cylindrical work-piece 28 is positioned so that its inner circumferential surface 54 is in facing relationship with the outer circumferential surfaces 56 and 58 of the support members 48 and 50 respectively, the engaged surfaces of work-piece 28 defining marginal edge portions. Thereafter, the hydraulic actuator 44 is operated to pull the draw bar 42 downwardly so that the cone 40 also moves downwardly and its surface 47 slides on the surfaces 46 of the segment assemblies 34 simultaneously moving all of the assemblies radially outwardly from the axis of the cone. Such movement causes the punch portions 52 of the segment assemblies 34 to engage the inner circumferential radially extending formed portion of surface 54 of the cylindrical work-piece 28. During initial movement of the segment assemblies 34, metal in the work-piece 28 is displaced outwardly as shown in FIG. 9. Continued movement of the segment assembly 34 further displaces the material in the work-piece 28 to form an annulus having a radially extending formed portion of generally U-shaped cross section, as indicated at 60 in FIG. 10. Upper and lower marginal portions 62 and 64 of the work-piece 28 remain in contact with the support members 48 and 50. Radial outward movement of the segment assemblies 34 can be continued by downward movement of the cone 40, to progressively displace the material of the work-piece 28 until it takes the configuration shown in FIG. 11 or FIG. 12, depending on the desired cross-sectional shape to be attained but in general having a U-shape in which the legs of the U are parallel to each other and immediately adjacent the edges of the support portions 48 and 50.

During expansion or displacement of the metal in the work-piece 28 radially outwardly, it will be noted that the support members 48 and 50 act to prevent the marginal edges 62 and 64 from being displaced. Moreover, as the metal is being displaced radially outward to a predetermined radius to form the U-shaped portion 60, the metal in the marginal edge portions 62 and 64 slides on the surfaces of the supports 48 and 50 and is displaced axially toward the center or U-shaped portion. The metal in the marginal edges and in the U-shaped portion retains its original thickness since during radial expansion the metal is unsupported at the radially outer surfaces of the annular ring and the metal is free to slide or flow in response to the radial forces exerted by the segment assemblies 34.

The method is particularly useful in forming annular rings in which the marginal edge portions 62 and 64 remain undistorted. It will be observed, that during the forming operation the entire outer circumferential surface of the work-piece is completely unsupported and unconfined, unlike prior types of operations which use a female die to receive the material of the work-piece.

The method is particularly useful in forming thin material into ornamental annular rings such as those used for decorative wheel trim on automotive vehicles.

Figure 13:
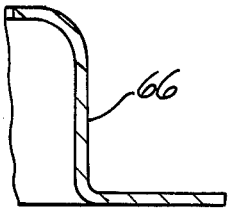
FIGS. 13 and 14 illustrate progressive steps in the formation of a pair of decorative rings from the ring shown in FIG. 2.
Figure 14:
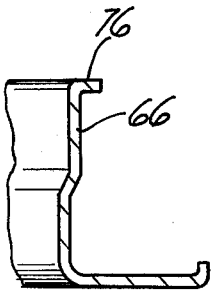
Figure 15:
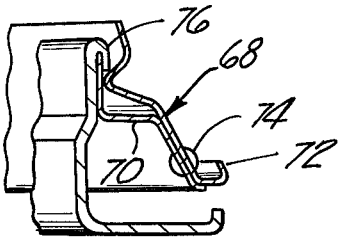
FIG. 15 is a cross-sectional view of a decorative trim rim of the type used for automotive wheels in which the decorative portion is made in accordance with the method of the present invention.

In the present method, this may be accomplished by forming an annular ring having a cross section such as that seen in FIG. 2. Thereafter, the ring 10 may be cut in a plane passing through the bight of the U-shaped portion 60 to form a pair of identical rings 66, such as shown in FIG. 13. Thereafter, the ring 66 may be formed by conventional methods to take the configuration shown in FIG. 14 in readiness to receive a retaining ring assembly 68, as seen in FIG. 15. The retaining ring assembly 68 includes an annular ring 70 which may be formed by conventional methods and may be of a lower grade material than the decorative ring 66. The annular ring 70 is provided with a plurality of retaining devices 72, only one of which is shown, which are connected to the retaining rings 70 by means of rivets 74 or the like. The retaining ring assembly 68 may be connected to the decorative ring 66 by folding over a flange portion 76 from the position from which it is shown in FIG. 13 to the position in which it is shown in FIG. 14.

Figure 11:
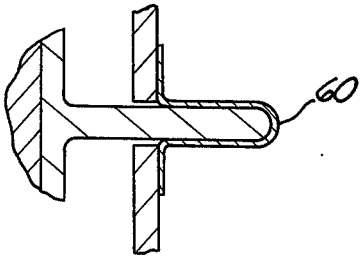
Figure 12:
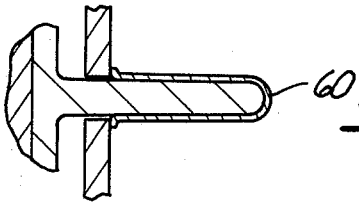

The method of the present invention is useful in forming annular rings of various configuration and is particularly useful in forming rings such as that shown in FIGS. 11 or 12 which may be later separated into a pair of rings 66 as shown in FIG. 13. Such an operation makes for high production rates and results in annular rings in which a substantial portion of the metal is disposed radially of the axis of the ring without the formation of wrinkles, stretch lines, thinning of the metal or the like, as occurs in conventional methods of forming with coacting male and female dies.

Figure 16:
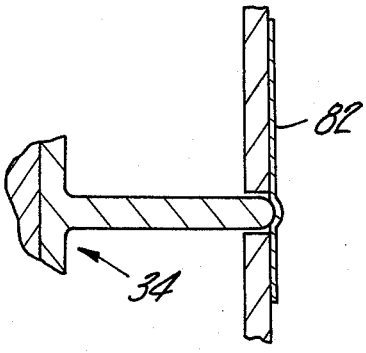
FIGS. 16, 17 and 18 illustrate progressive steps in the formation of another form of decorative ring in accordance with the method of the present invention.
Figure 17:
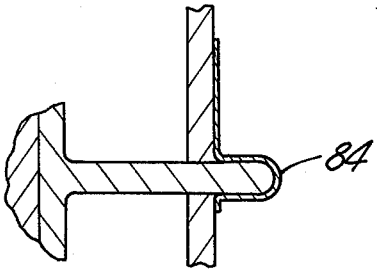
Figure 18:
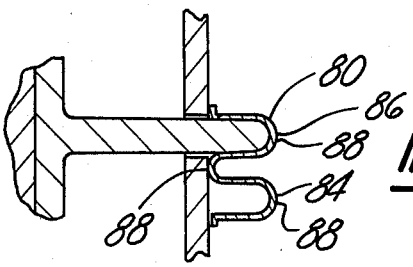

If desired, the method can be employed in forming annular rings of more complex shape as illustrated, for example, in FIGS. 16 through 18. To form a ring having a cross-sectional configuration, such as the ring 80 shown in FIG. 18, requires the prior formation of a ring-like work-piece 82 having an axial dimension equal to the length of the cross section of the ring 80. To form the ring 80, the work-piece 82 is positioned as illustrated in FIG. 16, and upon radial extension of the segment assemblies 34 a lower marginal portion of the work-piece 72 is formed with a U-shaped portion as indicated at 84 in FIG. 17. Thereafter, the segment assemblies may be retracted by moving the cone 40 upwardly and the work-piece may be moved from the position illustrated in FIG. 17 to a lower position after which the segment assembly 34 may be again displaced radially to displace metal in the upper marginal edge of the work-piece 82 to form a second U-shaped portion 86. The annular ring 80 may be severed at the points indicated at 88 to form four substantially identical rings each having a major portion of its material disposed radially of the axis of the rings.

A method of forming an annular ring from elongated strip material is provided in which the resultant ring has a substantial portion of its material disposed radially of the ring. Initially the strip is formed into a ring-like member with ends of the strip in adjacent relation to each other. Thereafter, the adjacent ends of the strip are welded by a plasma type welder to fuse the virgin material of the strip together to form a generally cylindrical work-piece. The cylindrical work-piece is thereafter, supported on its inner peripheral or circumferential surface over annular, radially spaced surfaces during which time a force is exerted radially outwardly over the entire circumference between the supported annular surfaces to displace material in the cylindrical work-piece radially outward. During such displacement of the material the entire outer surface of the work-piece remains unsupported so that the application of radial outward force serves to displace material both radially outwardly and the edges of the work-piece are displaced toward each other. The resultant ring has a substantial portion of its material disposed radially forming an annular portion with a U-shaped cross section with the cross section of the entire ring being generally symmetrical. The ring may be separated centrally of its U-shaped cross-sectional portion to form a pair of rings of identical cross section, each having material disposed radially of the axis of the rings. The method may be employed to form rings having multiple U-shaped portions which may be divided to form multiple rings. The resultant ring is formed by displacing material axially without preventing movement of portions of the material disposed axially so that the resultant ring is formed without the thinning of metal, stretch marks, or excessive elongation.

I claim:

1. The method of forming an annular ring comprising the steps of supporting a cylindrical member at marginal edge portions along the entire inner periphery at opposite sides of a selected annular portion on supporting apparatus having support members for engaging the inner periphery of the cylindrical member and defining an annular opening therebetween, the width of said opening corresponding to the width of the selected annular portion, and displacing said selected annular portion of said cylindrical member radially outwardly while maintaining the outer periphery of said cylindrical member unsupported on forming apparatus having a plurality of forming members movable radially outwardly between said support members, the selected annular portion being displaced to form a radially extending formed portion constituting a substantial portion of the annular ring and having a cross section with substantially parallel leg parts extending from immediately adjacent said support members and extending radially to a predetermined radius.

2. The method of claim 1 in which said cylindrical member is formed of an elongated strip of metal with the ends of said strip being connected to each other.

3. The combination of claim 2 wherein said elongated strip is formed of a length substantially equal to the inner circumference of said annular ring.

4. The method of claim 1 wherein the selected portion is displaced radially to form an annular formed portion having a generally U-shaped cross section disposed radially outwardly of the remainder of said cylindrical member.

5. The method of claim 2 in which said end portions of said strip of metal are joined together by plasma welding.

6. The method of claim 4 including the step of separating said annular ring intermediate the U-shaped portion to form a pair of rings.

7. The method of claim 1 in which the annular portion displaced radially forms a first U-shaped cross section, supporting said work-piece at axially spaced portions spaced axially from said first U-shaped portion, exerting a force radially outwardly on the circumferential portion of said work-piece between said last named spaced portions while maintaining the outer circumferential surface of said work-piece unsupported to displace portions of said work-piece radially to form a second U-shaped portion.

8. The method of claim 7 and further comprising separating said annular ring between said U-shaped portions to form a pair of rings each having a U-shaped cross section.

9. The method of claim 8 and further comprising separating each of said pair of rings at a point intermediate of said U-shaped cross sections to form two pairs of rings with each ring having a major portion of its material disposed in a radial direction.

10. The method of forming an annular ring having radially extending portions comprising; cutting a strip of elongated material to a length equal to the inner circumference of a ring to be formed, abutting the ends of said strip of material to form a ring, welding the abutting ends of said strip of material together to form a ring shaped workpiece having its material disposed in an axial direction, supporting said ring shaped workpiece at axially spaced annular marginal edge portions on supporting apparatus having support members for engaging said marginal edge portions and defining annular opening therebetween, said workpiece being supported on the internal circumference of said workpiece and at opposite marginal edges of said workpiece to leave an unsupported annular portion therebetween, and exerting a force radially outward on said unsupported annular portion while the external surface of said ring shaped workpiece is completely unsupported to displace material in said workpiece radially outward to form a radially extending formed portion of said annular ring and having substantially parallel leg parts extending from immediately adjacent said support members and extending equally from immediately adjacent said support members.

11. The method of claim 10 in which said annular portions are displaced axially toward each other while said unsupported annular portion is displaced radially.

12. The method of claim 11 in which the material displaced radially is generally U-shaped in cross section and the ring shaped work-piece is separated into a pair of generally symmetrical rings.

* * * * *